US009021622B2

(12) United States Patent
Kitaura et al.

(10) Patent No.: US 9,021,622 B2
(45) Date of Patent: May 5, 2015

(54) FLUSH TOILET DEVICE

(71) Applicant: Toto Ltd., Fukuoka (JP)

(72) Inventors: Hidekazu Kitaura, Fukuoka (JP); Ryoko Ishimaru, Fukuoka (JP); Tomohiro Iwabata, Fukuoka (JP); Yoshiki Ota, Fukuoka (JP); Takashi Yoshioka, Fukuoka (JP)

(73) Assignee: Toto Ltd., Fukuoka (JP)

( * ) Notice: Subject to any disclaimer, the term of this patent is extended or adjusted under 35 U.S.C. 154(b) by 0 days.

(21) Appl. No.: 14/052,222

(22) Filed: Oct. 11, 2013

(65) Prior Publication Data

US 2014/0109307 A1 Apr. 24, 2014

(30) Foreign Application Priority Data

Oct. 18, 2012 (JP) ..... 2012-231049

(51) Int. Cl.

| | |
|---|---|
| ***E03D 1/00*** | (2006.01) |
| ***E03D 11/08*** | (2006.01) |
| ***E03D 1/08*** | (2006.01) |

(52) U.S. Cl.

CPC ..... *E03D 11/08* (2013.01); *E03D 1/085* (2013.01); *E03D 2201/40* (2013.01)

(58) Field of Classification Search

CPC ..... E03D 1/36; E03D 5/01
USPC ..... 4/300, 329, 332, 334, 354, 374, 425
See application file for complete search history.

(56) References Cited

U.S. PATENT DOCUMENTS 6,502,251 B1 * 1/2003 Teshima et al. ..... 4/300

* cited by examiner

*Primary Examiner* — Tuan N Nguyen
(74) *Attorney, Agent, or Firm* — Studebaker & Brackett PC

(57) ABSTRACT

There is provided a flush toilet device capable of being configured in a compact size and supplying a sufficient flow amount of water to a toilet to reliably flush and discharge waste. According to the flush toilet device, a straight pipe portion of a throat which is arranged inside a tank is arranged in a state where a center axis thereof inclines with respect to a front-back direction of the tank when viewed from an upper side.

3 Claims, 7 Drawing Sheets

FLUSH TOILET DEVICE

BACKGROUND OF THE INVENTION

1. Field of the Invention

The present invention relates to a flush toilet device which receives waste egested by a user and discharges the waste with water.

2. Background Art

In the related art, a flush toilet device, in which a tank type or direct pressure type water supply mechanism is used as a mechanism for supplying flush water to the toilet which receives waste, has been widely distributed.

The tank type water supply mechanism is designed such that water is reserved in advance in a tank and the water is supplied as flush water to the toilet. Such a tank type water supply mechanism has a problem that the size of the tank mounted on the flush toilet device increases since it is necessary to reserve all water, which is to be supplied as the flush water, in the tank.

In addition, it is necessary to fill the tank with water up to a full water level after completion of the toilet flushing in order to prepare for next flushing, and it takes time to supply water to the large-sized tank and fill the tank with water up to the full water level. For this reason, there is a problem that it is difficult to continuously (at short intervals) flush the toilet by the tank type water supply mechanism and the tank type water supply mechanism is not suitable for a situation in which the flush toilet device is often used.

The direct pressure type water supply mechanism is designed such that water pressure in a water supply pipe arrangement (water pipe) arranged in a building is used to supply flush water from the water supply pipe arrangement to the toilet. Since the flow amount of the flush water depends on the water pressure in the water supply pipe arrangement according to such a direct pressure type water supply mechanism, there is a problem that the flushing performance deteriorates when the flush toilet device is installed in an environment with low water pressure (on an upper floor, for example). In addition, it is necessary to form the water supply pipe arrangement connected to the flush toilet device to have a large diameter in order to enable the direct pressure type water supply mechanism to supply a large amount of water. For this reason, there is a problem that extensive construction work is required.

As a water supply mechanism which can solve both the problems of the tank type water supply mechanism and the problems of the direct pressure type water supply mechanism as described above at the same time, a jet pump type water supply mechanism has been newly proposed (see Patent Document 1).

The jet pump type water supply mechanism disclosed in Patent Document 1 is provided with a tank which reserves water, and a jet pump unit is arranged inside the tank under the water. The jet pump unit includes a tubular throat. One end of the tubular throat is connected to a flow path which is directed to a bowl portion of the toilet, and an opening is formed at the other end. If water is jetted from the jet nozzle toward the inside of the throat through the opening, a jet pump action is induced, and a large amount of water thus flows inside the throat toward the bowl portion. That is, since not only water jetted from the jet nozzle but also water reserved in the tank are drawn (suctioned) and flow inside the throat, and therefore, a large amount of flush water is supplied to the toilet.

According to the jet pump type water supply mechanism, it is not necessary to reserve all water, which is to be supplied as flush water to the toilet, in the tank. For this reason, there are advantages that it is possible to reduce the size of the tank as compared with the tank type water supply mechanism and that it is possible to shorten the time required to fill the tank with water up to the full water level. In addition, it is possible to supply a large amount of flush water to the toilet even in a case where the flush toilet device is installed in an environment where water pressure in the water supply pipe arrangement is relatively low. Furthermore, there is also an advantage that extensive construction work for increasing the diameter of the water supply pipe arrangement is not required.

[Patent Document 1] Japanese Patent No. 3312625

SUMMARY OF THE INVENTION

In the jet pump type water supply mechanism as disclosed in Patent Document 1, there is a case where efficiency of the jet pump action decreases, momentum of water inside the throat is thus weakened, and the flow amount of water supplied to the toilet decreases. As a result, waste is not discharged from the toilet or the bowl portion of the toilet is not sufficiently flushed in some cases.

The reason that the decrease in efficiency of the jet pump action occurs is considered to be because resistance received by water flow in the throat increases as a result of occurrence of a backwater vortex in the water flow inside the throat and interference of the water flow by the inner surface of the throat. Therefore, it is necessary to suppress the aforementioned backwater vortex and interference by the inner surface of the throat and suppress the resistance received by the water flow in the throat in order to efficiently induce the jet pump action (in order to efficiently draw the water in the tank into the throat).

A backwater vortex in the water flow inside the throat mainly occurs since water flow from the nozzle reaches a non-linear part of the flow path inside the throat (a bending part of the flow path) at a high speed and the water flow separates from the inner surface of the throat. Since the vicinity of an inlet port of the throat is located near the nozzle jet port, water flow at a high speed is eccentrically located at a partial region of a cross section of the flow path, and separation as described above easily occurs. Therefore, it can be said that backwater vortex easily occurs in a case where the flow path inside the throat bends in the vicinity of the inlet port.

Thus, it is possible to achieve an idea that the shape of the throat is arranged in order to suppress the occurrence of such a backwater vortex. Specifically, it is possible to achieve an idea that a straight pipe portion which extends on a straight line is formed from the inlet port of the throat to the downstream side thereof along a jet direction of the jet nozzle.

Distribution of the flow rate at the cross section of the flow path is gradually uniformized while the water flows through the straight pipe portion. Therefore, the cross section of the flow path on the downstream side of the straight pipe portion is in a state where the water flow at the high speed is hardly eccentrically located at the cross section of the flow path on the downstream side of the straight pipe portion. As a result, separation as described above does not easily occur at the bending part on the further downstream side than the straight pipe portion, and a backwater vortex does not occur often.

Furthermore, the inner surface of the throat interferes with the water flow so as to change a traveling direction of the water flow (such that the water flow collides). If the flow path inside the throat bends at a vicinity of the inlet port, the inner surface of the throat interferes in a state where the water flow at the high speed is eccentrically located at a partial region of the cross section of the flow path, and therefore, backwater and the backwater vortex easily occur inside the throat, and the jet pump action is inhibited. On the other hand, if the straight pipe portion is formed at the throat as described above, the state where the water flow at the high speed is eccentrically located is alleviated, and an influence of the interference by the inner surface of the throat (on the inlet port side, in particular) on the water flow is suppressed.

In order to suppress resistance received by the water flow inside the throat and suppress degradation of the efficiency of the jet pump action, it is effective to form a straight pipe portion with a sufficient length on the upstream side (inlet port side) of the throat.

However, if the straight pipe portion is formed to have a length, with which a backwater vortex and interference of the throat inner surface can be sufficiently suppressed, the throat increases in size, and the tank which accommodates the throat therein also increases in size. That is, although an advantage achieved by employing the jet pump type water supply mechanism is that it is possible to decrease the size of the tank, the size of the tank increases in order to suppress degradation of the efficiency of the jet pump action, and the above advantage cannot be achieved.

The present invention was made in view of the above problems, and an object thereof is to provide a flush toilet device which is formed into a compact size and can supply a sufficient flow amount of water to a toilet to reliably flush and eject waste.

In order to solve the above problems, there is provided a flush toilet device which receives waste egested by a user and discharges the waste with water, including: a toilet which includes a bowl portion for receiving the waste and a water guide path formed therein to guide the water to the bowl portion; and a flush water supply device which supplies the water to the water guide path, wherein the flush water supply device includes a tank which reserves the water therein and includes a supply port formed to supply the water to the water guide path, a jet nozzle which is arranged on a lower side in the tank and jets the water, a jet water supply pipe arrangement which supplies the water to the jet nozzle, and a throat which is a pipe arranged inside the tank and connected to the supply port on one end side, wherein the throat includes an inlet port portion which causes water jetted by the jet nozzle and water inside the tank to be drawn by the jetted water to flow therein, a straight pipe portion which is formed so as to extend on a straight line from the inlet port portion along a jet direction of the jet nozzle, a bending portion which is a part on a further downstream side than the straight pipe portion and is formed so as to bend, and an outlet port portion which is a part connected to the supply port and causes water passing through the straight pipe portion and the bending portion to flow out to the supply port, and wherein the straight pipe portion is arranged in a state where a center axis thereof inclines with respect to a front-back direction of the tank when viewed from an upper side.

The flush toilet device according to the present invention is provided with the toilet and the flush water supply device. The toilet includes the bowl portion as a part for receiving waste egested by the user. In addition, the water guide path for guiding water (flush water) to the bowl portion is formed inside the flush toilet device.

The flush water supply device is a device for supplying water to the water guide path of the toilet. If water is supplied to the water guide path by the flush water supply device, the water is guided to the bowl portion to flush the bowl portion and discharge the waste. The flush water supply device includes the tank, the jet nozzle, the jet water supply pipe arrangement, and the throat.

The tank is a container for reserving water therein. The supply port for supplying the reserved water to the water guide path of the toilet is formed at the tank. That is, the supply port is for discharging the water in the tank to the outside, and the supply port and the water guide path are connected to each other directly or via a pipe arrangement or the like so as to supply the discharged water to the water guide path.

The jet nozzle is a nozzle for jetting water and is arranged below the tank. In addition, the jet water supply pipe arrangement is a pipe arrangement connected to the jet nozzle and supplies the water, which is jetted from the jet nozzle, to the jet nozzle. That is, the water jetted from the jet nozzle is not water reserved in the tank but water supplied from the jet water supply pile arrangement to the jet nozzle.

The throat is a pipe arranged inside the tank and connected to the supply port of the tank on one end side (a side of the outlet port portion). The throat includes the inlet port portion, into which the water jetted from the jet nozzle flows. The throat has a configuration in which the water flowing from the inlet port portion into the throat flows through the inside of the (tubular) throat and is supplied from the supply port to the water guide path.

If water is jetted from the jet nozzle to the inlet port portion of the throat, a jet pump action is induced by the water flow. That is, the water reserved inside the tank is drawn (attracted) toward the inside of the throat due to the water flow from the jet nozzle. As a result, the flow amount of the water flowing through the inside of the throat toward the supply port corresponds to a flow amount obtained by adding the water drawn into the throat pipe from the inside of the tank to the flow amount of the water jetted from the jet nozzle. That is, a larger flow amount of water than the flow amount of water jetted from the jet nozzle is supplied as flush water to the toilet.

The throat includes a straight pipe portion which is formed so as to extend on a straight line from the inlet port portion along the jet direction of the jet nozzle and a bending portion which is a part on the further downstream side than the straight pipe portion and is formed so as to bend. The throat further includes an outlet port portion, which is a part connected to the supply port, from which the water passing through the straight pipe portion and the bending portion flows out. The water flowing from the inlet port portion into the throat passes through the straight pipe portion and the bending portion, then flows out from the outlet port portion to the supply port, and is supplied to the toilet via the water guide path.

Since such a straight pipe portion is formed at a part of the throat on the upstream side, occurrence of a vortex inside the throat and interference of the inner surface of the throat with the water flow are suppressed. As a result, resistance received by the water flow inside the throat is suppressed, a decrease in efficiency of the jet pump action is suppressed, and therefore, it is possible to efficiently increase the flow amount and supply water to the water guide path.

Furthermore, the straight pipe portion of the throat is arranged in a state where the center axis thereof inclines with respect to the front-back direction of the tank when viewed from the upper side in the present invention. That is, the center axis of the straight pipe portion is not along the front-back direction or the right-left direction of the tank when viewed from the upper side, the center axis is obliquely located with respect to the front-back direction of the tank (it can be said that the center axis is obliquely located with respect to the right-left direction).

Since the straight pipe portion of the throat pipe is arranged as described above, it is possible to sufficiently secure the length of the straight pipe portion without increasing the size of the tank. In other words, it is possible to sufficiently secure the length of the straight pipe portion of the throat by efficiently using the space inside the tank. As a result, it is possible to configure the entire flush toilet device in a compact size, to suppress a degradation of the efficiency of the jet pump action, and to supply a sufficient flow amount of water to reliably flush the toilet and discharge the waste.

In the flush toilet device according to the present invention, the tank preferably includes a bottom wall which forms a bottom surface of the tank, a first side wall which extends upward from the bottom wall and forms a side surface of the tank on a left side, and a second side wall which extends upward from the bottom wall and forms a side surface of the tank on a right side, and the inlet port portion is preferably arranged at a position in a vicinity of one of the first side wall and the second side wall, which is located at a further position from the outlet port portion.

In the preferred configuration, the tank includes the bottom wall which forms the bottom surface of the tank, the first side wall which extends upward from the bottom wall and forms a side surface of the tank on the left side, and the second side wall which extends upward from the bottom wall and forms a side surface of the tank on the right side. In addition, the inlet port portion of the throat is arranged at the position in the vicinity of one of the first side wall and the second side wall, which is located at a further position from the outlet port portion.

That is, in a case where the outlet port portion is arranged at a position in the vicinity of the first side wall, the inlet port portion is arranged at a position in the vicinity of the second side wall. On the other hand, in a case where the outlet port portion is arranged at a position in the vicinity of the second side wall, the inlet port portion is arranged at a position in the vicinity of the first side wall. Moreover, in a case where the outlet port portion is arranged at a center position of the tank in the right-left direction, the inlet port portion may be arranged at any one of the position in the vicinity of the first side wall and the position in the vicinity of the second side wall.

With such an arrangement, it is possible to arrange the straight pipe portion of the throat by efficiently utilizing a larger one of a space between the first side wall and the outlet port portion and a space between the second side wall and the outlet port portion. It is possible to secure a long length of the straight pipe portion in the right-left direction of the tank to the maximum extent and to thereby efficiently induce the jet pump action and supply a sufficient flow amount of water to the toilet to reliably flush the toilet and discharge the waste.

In the flush toilet device according to the present invention, the tank preferably further includes a third side wall which extends upward from the bottom wall and forms a side surface of the tank on a front side, and a fourth side wall which extends upward from the bottom wall and forms a side surface of the tank on a back side, and the inlet port portion is preferably arranged at a position in a vicinity of one of the third side wall and the fourth side wall, which is located at a further position from the outlet port portion.

In the preferred configuration, the tank further includes the third side wall which extends upward from the bottom wall and forms a side surface of the tank on the front side and the fourth side wall which extends upward from the bottom wall and forms a side surface of the tank on the back side. In addition, the inlet port portion of the throat is arranged at a position in the vicinity of one of the third side wall and the fourth side wall, which is located at a further position from the outlet port portion.

That is, in a case where the outlet port portion is arranged at a position in the vicinity of the third side wall, the inlet port portion is arranged at a position in the vicinity of the fourth side wall. On the other hand, in a case where the outlet port portion is arranged at a position in the vicinity of the fourth side wall, the inlet port portion is arranged at a position near the third side wall. In addition, in a case where the outlet port portion is arranged at the center position of the tank in the front-back direction, the inlet port portion may be arranged at any one of the position in the vicinity of the third side wall and the position in the vicinity of the fourth side wall.

With such an arrangement, it is possible to arrange the straight pipe portion of the throat by efficiently utilizing a larger one of a space between the third side wall and the outlet port portion and a space between the fourth side wall and the outlet port portion. It is possible to secure the length of the straight pipe portion even in the front-back direction as well as in the right-left direction of the tank as long as possible and to thereby more efficiently induce the jet pump action and supply a sufficient flow amount of water to the toilet to reliably flush the toilet and discharge the waste.

In the flush toilet device according to the present invention, the supply port is preferably formed so as to penetrate through the bottom wall, and the tank is preferably arranged at a part of an upper surface of the toilet on a backward side, the inlet port portion is preferably arranged in a vicinity of the third side wall, and the outlet port portion is preferably arranged in a vicinity of the fourth side wall.

In the preferred configuration, the supply port is formed so as to penetrate through the bottom wall, and the tank is installed at a part of the upper surface of the toilet on the backward side. For this reason, the outlet port portion of the throat is connected to the bottom wall of the tank.

In addition, the inlet port portion is arranged in the vicinity of the third side wall, and the outlet port portion is arranged in the vicinity of the fourth side wall. Since the throat is arranged inside the tank as described above, the position of the inlet port portion is not on the further backward side than the position of the outlet port portion which is connected to the bottom wall of the tank. In other words, it is not necessary to extend the shape of the tank toward the backward side for the purpose of arranging the inlet port portion. As a result, it is possible to suppress a decrease in dimension of the entire flush toilet device in the front-back direction and to thereby enhance a degree of freedom for installing the flush toilet device.

According to the present invention, it is possible to provide a flush toilet device capable of being configured in a compact size and supplying a sufficient flow amount of water to a toilet to reliably flush the toilet and discharge waste.

DESCRIPTION OF THE PREFERRED EMBODIMENTS

Figure 1:
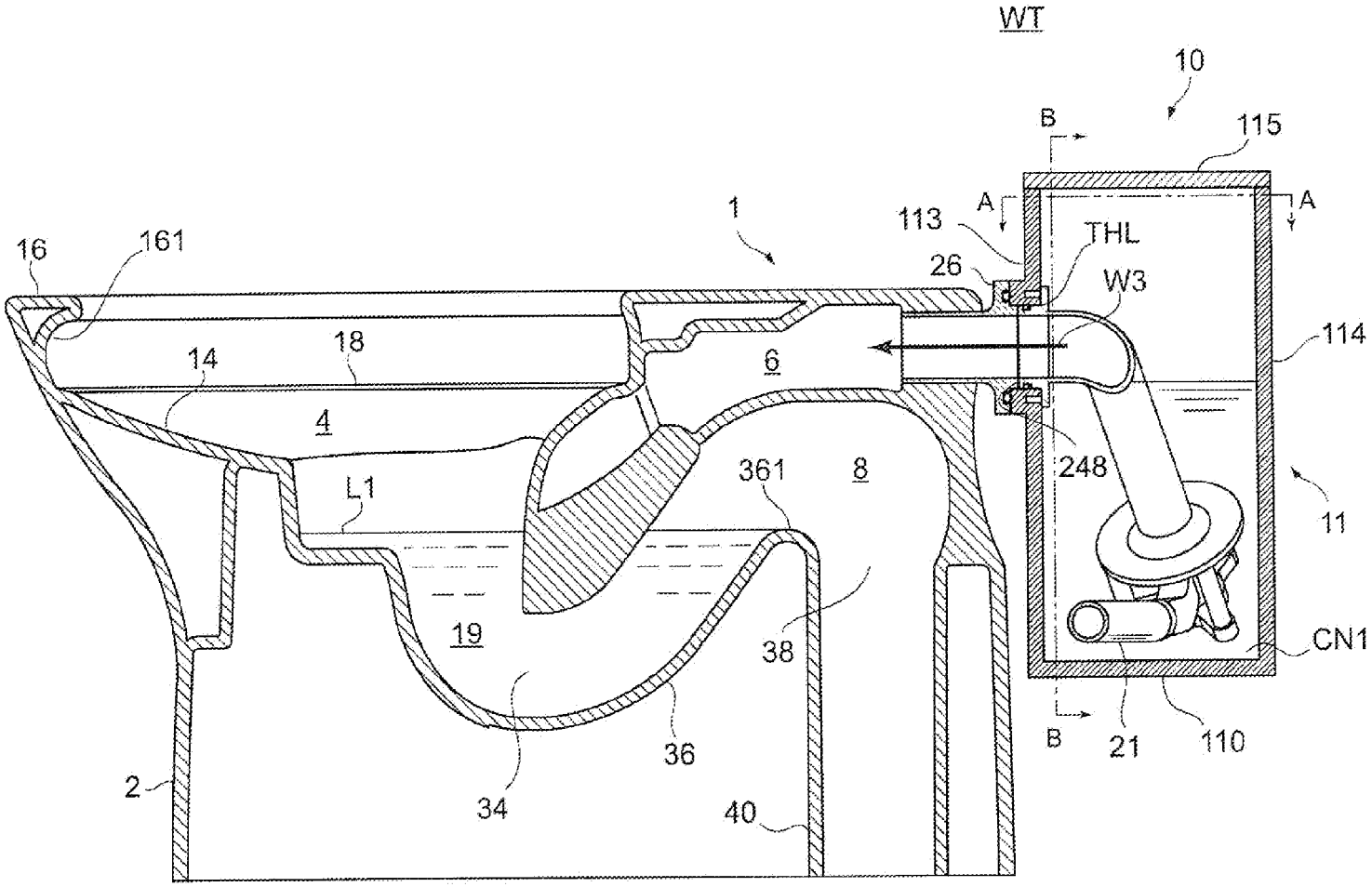
FIG. 1 is an outlined side cross-sectional view of a flush toilet device according to a first embodiment of the present invention.

Hereinafter, a description will be given of embodiments of the present invention with reference to accompanying drawings. In order to make it easier to understand the description, the same reference numerals will be given to the same constituents in the respective drawings as long as possible, and repeated description will be omitted.

Figure 2:
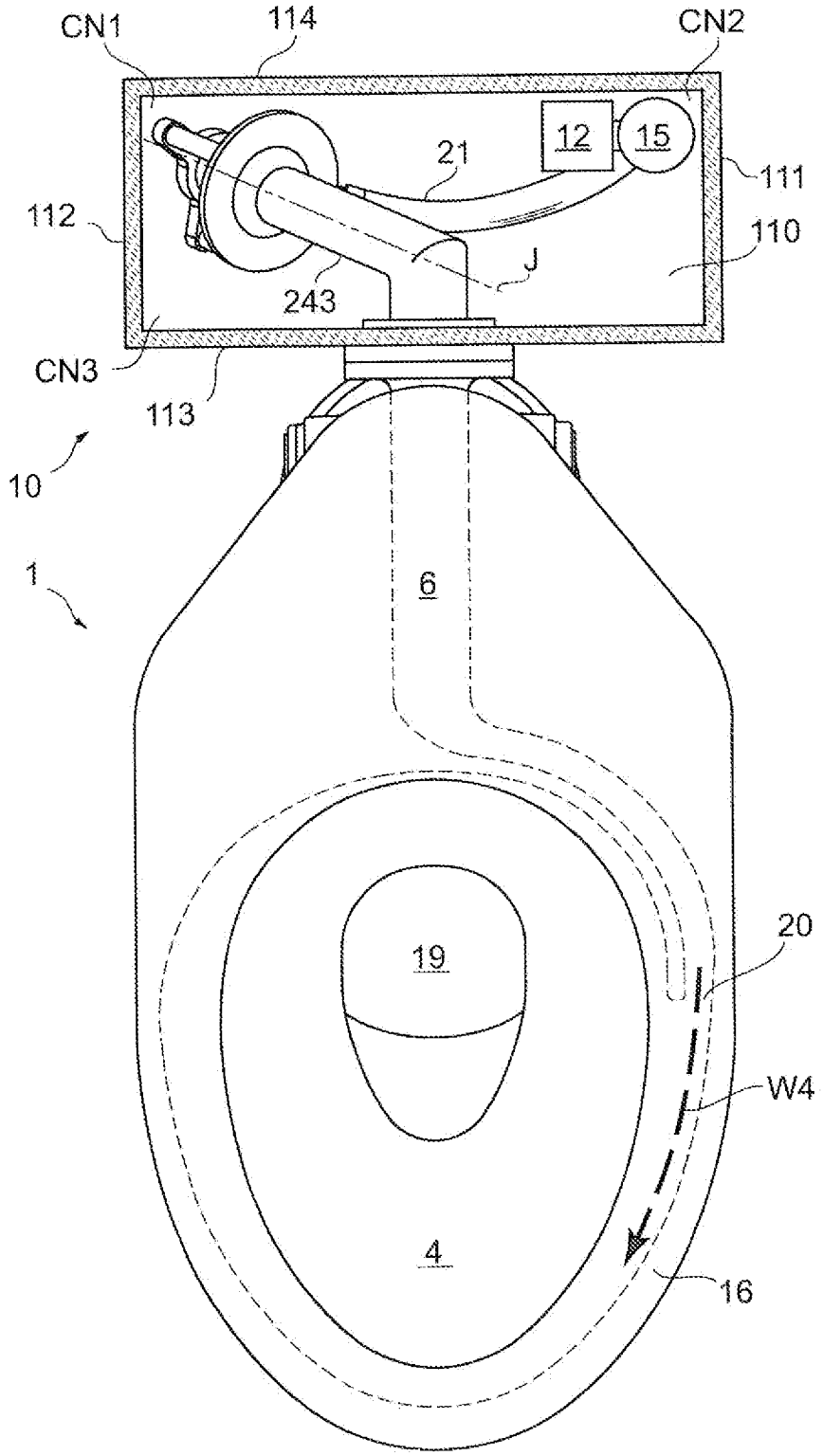
FIG. 2 is an arrow view from an A-A direction in FIG. 1.
Figure 3:
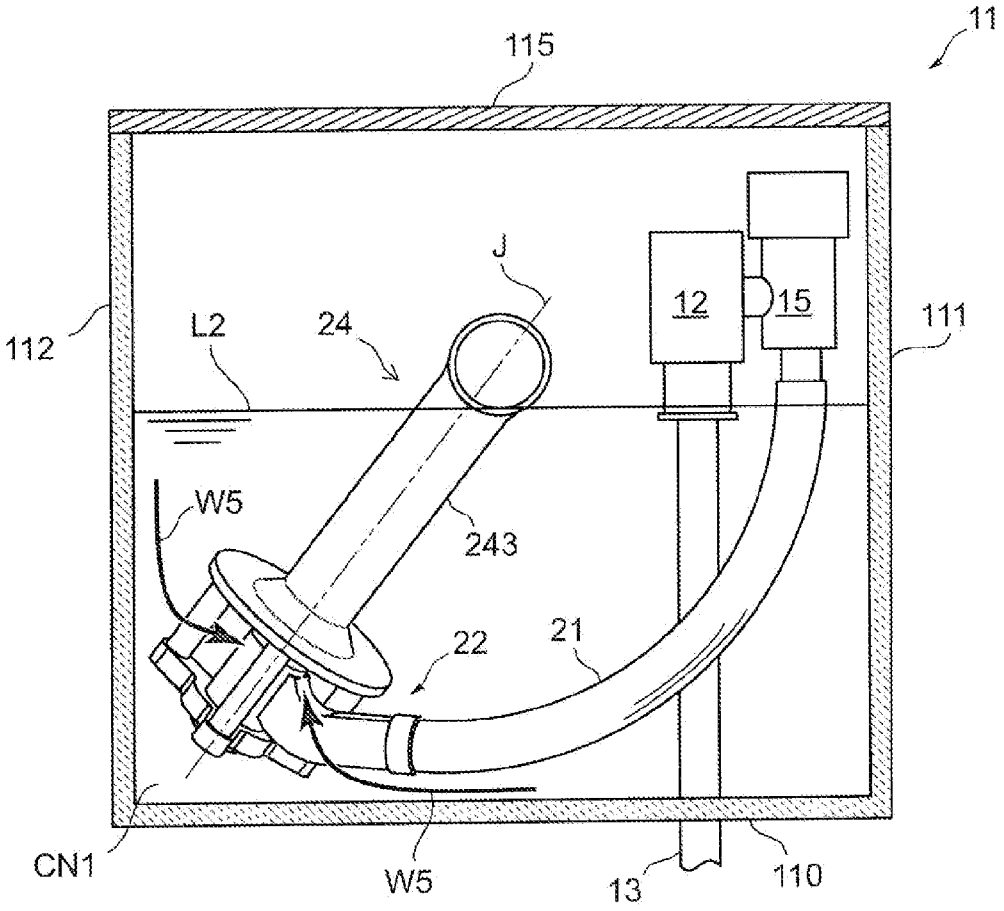
FIG. 3 is an arrow view from a B-B direction in FIG. 1.
Figure 4:
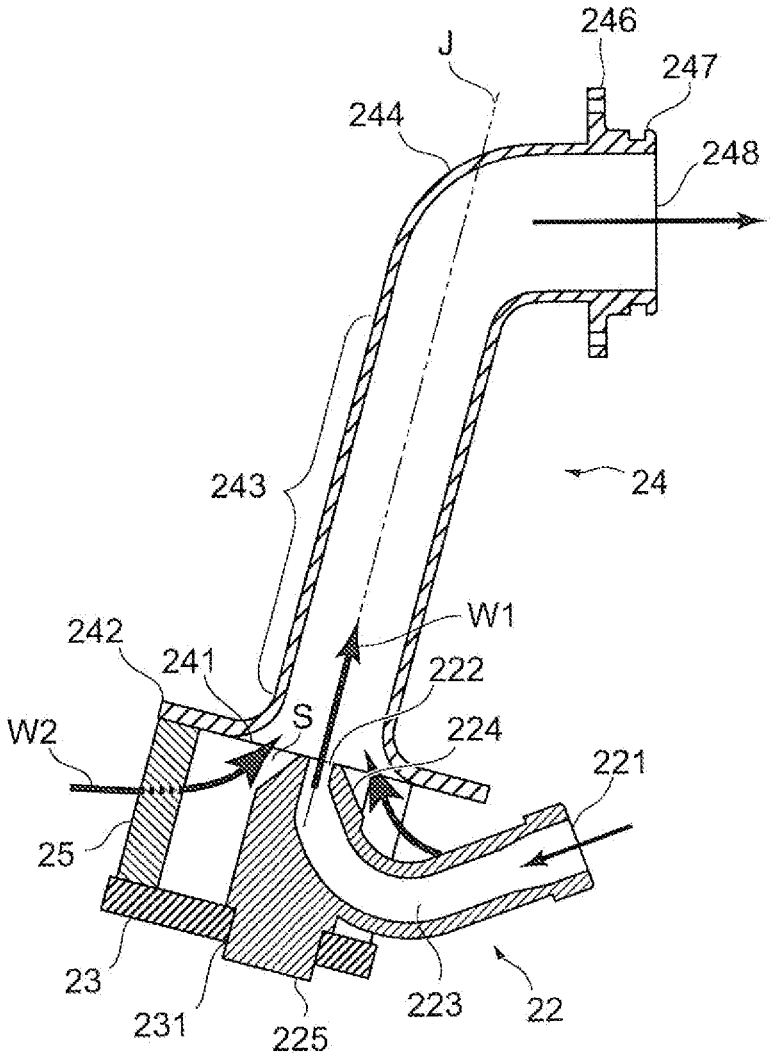
FIG. 4 is a cross-sectional view illustrating inner shapes of a jet nozzle and a throat provided in the flush toilet device shown in FIG. 1.

FIG. 1 is an outlined side cross-sectional view of a flush toilet device according to a first embodiment of the present invention. FIG. 2 is an arrow view from an A-A direction in FIG. 1. FIG. 3 is an arrow view from a B-B direction in FIG. 1. FIG. 4 is a cross-sectional view illustrating inner shapes of a jet nozzle and a throat provided in the flush toilet device shown in FIG. 1.

As shown in FIGS. 1 and 2, a flush toilet device WT is provided with a flush toilet 1 and a flush water supply device 10. The flush toilet 1 is a ceramic with a glaze layer formed on the surface, a skirt portion 2 is formed at a lower part, and a bowl portion 4 is formed on a front side of an upper half. In addition, a water guide path 6 is formed at a back upper part (inside) of the flush toilet 1, and a discharge water trap portion 8 for discharging waste is formed at a back lower part. The flush water supply device 10 is a device for supplying flush water to the flush toilet 1 and is arranged behind the flush toilet 1.

In the following description, a right side viewed from a user seated on the flush toilet 1 (a further side of the plane of paper of FIG. 1) will be referred to as a "right side", and a left side viewed from the user seated on the flush toilet 1 (a front side of the plane of paper of FIG. 1) will be referred to as a "left side" unless otherwise noted. In addition, a forward side viewed from the user seated on the flush toilet 1 (a left side in FIG. 1) will be referred to as a "front side" or a "forward side", and a backward side viewed from the user seated on the flush toilet 1 (a right side in FIG. 1) will be referred to as a "back side" or a "backward side".

The bowl portion 4 is provided with a bowl-shaped waste receiving surface 14, a rim portion 16 which configures an upper edge portion, a rack portion 18 which is formed on a lower end side of the rim portion 16, a water retaining portion 19 formed below the waste receiving surface 14. Here, an inner circumferential surface 161 of the rim portion 16 has an inward overhang shape as shown in FIG. 1 such that circling water which will be described later does not flow out. In addition, the rack portion 18 is substantially horizontally formed (or formed so as to be slightly inclined inward) as shown in FIG. 1 and is formed in a ring shape at the entire circumference of the bowl portion 4.

As shown in FIG. 2, a water ejecting portion 20 which ejects water is formed at a part of the rim portion 16 (inner circumferential surface 161) on the left side. The water ejecting portion 20 opens such that ejected water forms circling flow in the clockwise direction. The aforementioned water guide path 6 is a water flow path formed inside the flush toilet 1 and is formed so as to extend forward from an end portion of the flush toilet 1 on the backward side to the water ejecting portion 20.

As shown in FIG. 1, the discharge water trap portion 8 is provided with an inlet port 34 which opens near a bottom of the bowl portion 4, an ascending path 36 which obliquely extends from the inlet port 34 to the back upper side, and an expanded portion 38 which is formed on the back upper side on the downstream side of the ascending path 36, and a descending path 40 which extends downward from the expanded portion 38. A cross section of the flow path of the expanded portion 38 is larger than the cross section of the flow path of the inlet port 34.

Here, the ascending path 36 includes an upper end portion 361, and a position of a retained water surface (initial retained water level) L1 in the water retaining portion 19 of the bowl portion 4 depends on a position of the upper end portion 361.

In addition, volume and height of the expanded portion 38 are set such that waste can be flushed away by a water flowing action caused by water falling, which is a flushing mechanism of a so-called "wash-out type toilet".

The flush water supply device 10 includes a tank 11 which reserves flush water therein. As shown in FIG. 1, the tank 11 includes a bottom wall 110, a front side wall 113 which extends upward from an end portion of the bottom wall 110 on the forward side, and a back side wall 114 which extends upward from an end portion of the bottom wall 110 on the backward side. The bottom wall 110 forms a bottom surface of the tank 11. The front side wall 113 forms a side surface of the tank 11 on the front side, and the back side wall 114 forms a side surface of the tank 11 on the back side. A tank supply port THL is provided at the front side wall 113.

As shown in FIG. 2, the tank 11 includes a left side wall 111 which extends upward from an end portion of the bottom wall 110 on the left side and a right side wall 112 which extends upward from an end portion of the bottom wall 110 on the right side. The left side wall 111 forms a side surface of the tank 11 on the left side, and the right side wall 112 forms a side surface of the tank 11 on the right side.

Furthermore, an upper portion of the tank 11 is covered with a cover 115 as shown in FIG. 1. An outer shape of the tank 11 is a substantially rectangular parallelepiped shape, in which a front-back dimension is smaller than a right-left dimension.

As shown in FIG. 3, an upstream water supply pipe 13 which is connected to a tap water pipe arrangement penetrates through the bottom wall 110 of the tank 11. A flush valve 12 is arranged inside the tank 11 and is connected to an upper end of the upstream water supply pipe 13. The flush valve 12 is a known valve which opens and closes in response to a user operating an operation lever (not shown) at the time of flushing the flush toilet 1, and is configured so as to make water flow to the downstream side when opened.

A vacuum breaker 15 is connected to the flush valve 12 on the downstream side. The vacuum breaker 15 is arranged at a position higher than a water level (maximum water level L2) when the inside of the tank 11 is completely filled with water. The vacuum breaker 15 prevents water from flowing from a side of the flush valve 12 toward a side of the upstream water supply pipe 13 (backwater).

A jet water supply pipe arrangement 21 and a jet nozzle 22 are connected in this order to the vacuum breaker 15 on the downstream side. The jet water supply pipe arrangement 21 is a flexible hose. Water supplied from the upstream water supply pipe 13 to the flush valve 12 and passing through the vacuum breaker 15 is guided by the jet water supply pipe arrangement 21 to the jet nozzle 22. The jet water supply pipe arrangement 21 declines from a side of the vacuum breaker 15 to a vicinity of the bottom wall 110 of the tank 11 and extends up to the jet nozzle 22, and at least a part thereon on the side of the jet nozzle 22 is under water reserved inside the tank 11 as shown in FIG. 3.

As shown in FIG. 4, the jet nozzle 22 is configured to have introduction port 221 which introduces water supplied from the jet water supply pipe arrangement 21 to the inside, a jet port 222 which jets the water introduced by the introduction port 221 to the outside, and an introduction path 223 which is a flow path connecting the introduction port 221 to the jet port 222. The jet port 222 has a cross section opening in a substantially circular shape, a center line J thereof is directed upward, and water is jetted in a direction along the center axis J (a direction of an arrow W1 shown in FIG. 4). An outer side surface 224 around the jet port 222 has a tapered shape, and the introduction path 223 has a substantially U-shape such that the water introduced by the introduction port 221 is directed in the direction along the center line J.

A fixing plate 23 with a fixing hole 231 is arranged below the jet nozzle 22. A protrusion portion 225 formed at a lower end of the jet nozzle 22 is fitted into the fixing hole 231, and the jet nozzle 22 is thus fixed.

A tubular throat 24 is arranged above the jet nozzle 22. A throat inlet port 241 with a circular cross section opens at a lower end portion of the throat 24, and a brim-shaped inlet port flange 242 is provided at a circumferential edge of the throat inlet port 241 so as to protrude to the outside. In addition, the inlet port flange 242 and the fixing plate 23 are coupled by three support pillars 25 arranged around the jet port 222. With such a configuration, the throat 24 is fixed inside the tank 11 in a state where the throat inlet port 241 faces the jet port 222.

The throat 24 includes a straight pipe portion 243 with a circular cross section. The straight pipe portion 243 is a part formed so as to extend from the throat inlet port 241 on a straight line, and a center axis thereof is coaxial with the center axis J of the jet port 222. In other words, the straight pipe portion 243 is a part formed so as to extend on a straight line along the jet direction (the direction of the center axis J) of the jet nozzle 22.

An elbow portion 244 which bends such that an internal flow path is directed in the horizontal direction is provided on the downstream side of the straight pipe portion 243 of the throat 24, and a brim-shaped outlet port flange 246 is provided at an end portion thereof on the downstream side so as to protrude outward. A connecting portion 247 is formed at the throat 24 on the further downstream side than the outlet port flange 246, and a throat outlet port 248 which is an opening is formed at an end on the downstream side of the connecting portion 247. The connecting portion 247 is fitted into the tank supply port THL shown in FIG. 1, and the outlet port side of the throat 24 is thus fixed. That is, one end side of the tubular throat 24 (the side of the throat outlet port 248) is connected to the tank supply port THL.

As shown in FIGS. 1 and 3, the jet nozzle 22 and the throat inlet port 241 are arranged under water in the vicinity of the bottom wall 110 of the tank 11. Furthermore, the throat inlet port 241 is arranged in the vicinity of a corner CN1 which is defined by the bottom wall 110, the back side wall 114, and the right side wall 112 as can be understood from FIGS. 1 to 3. The jet nozzle 22 is arranged between the corner CN1 and the throat inlet port 241 (below the throat inlet port 241).

The straight pipe portion 243 is formed so as to extend obliquely upward from the throat inlet port 241. The center axis of the straight pipe portion 243 inclines with respect to a front-back direction of the tank 11 when viewed from an upper side as shown in FIG. 2 (it can also be said that the center axis inclines with respect to a right-left direction of the tank 11). That is, the straight pipe portion 243 extends in a direction from the throat inlet port 241 which is arranged in the vicinity of the corner CN1 toward the sides of the front side wall 113 and the left side wall 111.

As shown in FIGS. 2 and 3, the jet water supply pipe arrangement 21 is arranged between the straight pipe portion 243 and the bottom wall 110 of the tank 11 (below the straight pipe portion 243) and is overlapped with a part of the straight pipe portion 243 when viewed from the upper side. Furthermore, the flush valve 12 which opens and closes the flow path communicating with the jet water supply pipe arrangement 21 is arranged in a vicinity of a corner CN2 which is defined by the cover 115, the back side wall 114, and the left side wall 111 as shown in FIG. 2.

Here, a description will be given of operations of the flush toilet device WT according to this embodiment. Before flushing (using) the flush toilet 1, a predetermined amount of water is reserved in the water retaining portion 19, the bowl portion 4, and the tank 11 for next usage and flushing of the toilet as shown in FIGS. 1 and 3. That is, water is reserved in the water retaining portion 19 up to a position of L1 which is determined by the upper end portion 361. In addition, water is retained in the tank 11 up to a position of the maximum water level L2.

If a user operates the operation lever (not shown) to flush the flush toilet 1, the flush valve 12 opens. In doing so, water starts to flow from the upstream water supply pipe 13. The water is supplied to the upstream water supply pipe 13 by pressure of the tap water pipe arrangement, and then supplied to the jet nozzle 22 through the flush valve 12, the vacuum breaker 15, and the jet water supply pipe arrangement 21. That is, water from the tap water pipe arrangement is supplied to the jet nozzle 22.

The water which is supplied to the jet nozzle 22 is jetted as a cylindrical jetted flow from the jet port 222 along the center axis J as shown by the arrow W1 in FIG. 4. Since the flow path width of the introduction path 223 of the jet nozzle 22 decreases toward the jet port 222, the cylindrical jetted flow becomes a high-speed jetted flow at an increased flow rate. Since the jet port 222 faces the throat inlet port 241 at the front, the speed of the water jetted from the jet nozzle 22 does not decrease, and the water flows into the throat 24.

If the high-speed jetted flow from the jet port 222 flows from the throat inlet port 241 into the throat 24, water in the tank 11 is drawn (attracted) outside the jetted flow, and the water flows into the throat 24. The flow of the water drawn from the inside of the tank 11 as described above is shown by an arrow W2 in FIG. 4.

An outer surface of the jet nozzle 22 is not in contact with an inner surface of the throat 24, and a gap S is formed at the entire circumference of the jet port 222. For this reason, the flow of the water drawn from the inside of the tank 11 occurs at the entire circumference of the jet nozzle 22. Both the water jetted from the jet nozzle 22 and the water drawn from the inside of the tank 11 flow from the throat inlet port 241 into the throat 24 and flow through the straight pipe portion 243.

Since the water drawn from the inside of the tank 11 in addition to the water jetted from the jet nozzle 22 flow inside the throat 24, a large flow amount of water flows. In other words, a large flow amount of water flows inside the throat 24 since the flow amount of water jetted from the jet nozzle 22 is amplified by a jet pump action.

The water which flows inside the throat 24 passes through the tank supply port THL from the throat outlet port 248 and flows out of the tank 11 as shown by an arrow W3 in FIG. 1.

As shown in FIG. 1, the inlet port of the water guide path 6 opens at an end portion of the flush toilet 1 on the back side, and the inlet port is connected to the tank supply port THL via a water supply socket 26. For this reason, the water which flows inside the throat 24 and then flows out of the tank 11 is supplied to the water guide path 6 via the water supply socket 26. The water which is supplied to the water guide path 6 is ejected from the water ejecting portion 20 to the rack portion 18 as shown in FIG. 2 and flows while cycling at the rim portion 16 along the rack portion 18 in the clockwise direction (shown by an arrow W4). Thereafter, the water flows downward from the rack portion 18, is supplied to the bowl portion 4, and flushes the bowl portion 4. The water which is supplied to the bowl portion 4 passes through the water retaining portion 19, the ascending path 36, the discharge water trap portion 8, and the descending path 40 in this order and is discharged with waste to an outside sewage pipe.

Since the flush valve 12 is automatically brought into a closed state if a predetermined amount of water flows, and the water supply to the jet nozzle 22 is stopped. The flush valve 12 is designed or adjusted such that the water supply is stopped at timing after reliably flushing bowl portion 4 and discharging waste.

At timing, at which the water supply from the flush valve 12 to the jet nozzle 22 is stopped, namely at timing, at which the water supply to the flush toilet 1 is stopped, the water level in the tank 11 is lowered. The flush toilet device WT is provided with a water supply mechanism which is not shown in the drawing. At substantially the same timing, at which the water supply to the flush toilet 1 is stopped, water supply to the tank 11 by the water supply mechanism is started. In doing so, the water level in the tank 11 rises and eventually recovers the water level (maximum water level L2) shown in FIG. 1.

Figure 5:
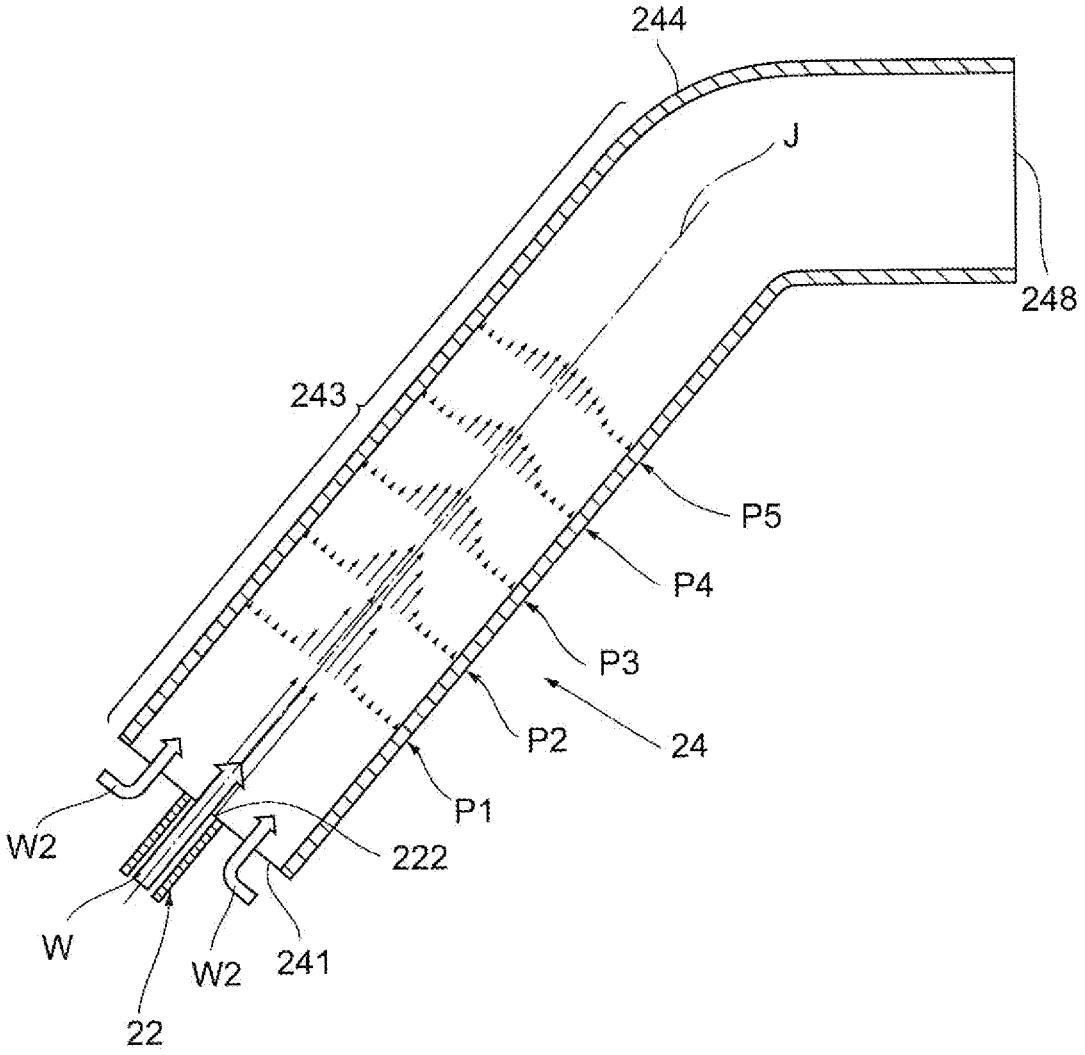
FIG. 5 is a diagram schematically illustrating water speed distribution inside the throat.

Here, a description will be given of water flow in the throat 24 when water is supplied to the flush toilet 1 with reference to FIG. 5. FIG. 5 is a diagram schematically illustrating water flow rate distribution inside the throat 24. Although FIG. 5 is a cross-sectional view showing an internal shape of the throat 24 in the same manner as FIG. 4, the inlet port flange 242, the outlet port flange 246, and the like are not shown in the drawing, and the shape of the throat 24 is simplified. Similarly, the shape of the jet nozzle 22 is also simplified.

FIG. 5 shows a state in which water is jetted from the jet nozzle 22 and flows inside the throat 24 toward the throat outlet port 248. In addition, flow rate distribution at respective cross sections of the flow path at five locations (a position P1, a position P2, a position P3, a position P4, and a position P5 in an order from the upstream side) in the straight pipe portion 243 is schematically shown by arrows in FIG. 5.

As shown in FIG. 5, a flow rate is high in a region in the vicinity of the center axis J (jetted flow inside region) in the cross section of the flow path at the position P1, which is close to the throat inlet port 241 of the straight pipe portion 243, due to an influence of the jet flow from the jet nozzle 22. On the other hand, a flow rate is lower in a region which is far from the center axis J in the cross section of the flow path (a region which is close to the inner wall of the throat 24: jet flow outside region) than in the region in the vicinity of the center axis J due to a relatively low influence of the jet flow from the jet nozzle 22. As described above, high-speed water flow is eccentrically located at a partial region (the region in the vicinity of the center axis J) in the cross section of the flow path.

At a jet flow outer edge portion (a border between the jet flow inside region and the jet flow outside region), fluid inside and outside the jet flow is mixed up due to a vortex caused by a difference in speeds inside and outside the jet flow. Therefore, the flow amount of the inner fluid which is transported by the jet flow increases towards the downstream side by gradually taking the outer fluid therein (jet pump action). In other words, momentum is exchanged between fluid elements inside and outside the jet flow at the jet flow outer edge portion, the outer fluid receives momentum from the inner fluid and is accelerated and taken in the jet flow. The inner fluid passes the momentum to the outer fluid and is decelerated. That is, the distribution of water flow rate at the cross sections of the flow path is gradually uniformized while the water flows through the straight pipe portion 243. As respectively shown by the arrows at the positions P1 to P5 in FIG. 5, a difference between the water flow rate (maximum flow rate) in a region in the vicinity of the center axis J and a water flow rate (minimum flow rate) in a region near the inner wall of the throat 24 gradually decreases toward the downstream side. As a result, the distribution of the flow rate of the water which has reached the elbow portion 244 is substantially uniformized in the entire cross section of the flow path.

As can be understood from the above description, the water flowing through the straight pipe portion 243 reaches the elbow portion 244 while the distribution of the flow rate thereof is not uniformized (in a state where a high-speed water flow is eccentrically localized in a partial region) if the length of the straight pipe portion 243 is not sufficient. In such a case, the high-speed water flow which has reached the elbow portion 244 separates from the inner wall on the inner circumferential side of the elbow portion 244, and a backwater vortex, at which the water flow remains, is formed. If the backwater vortex occurs in the water flow, energy is unnecessarily consumed at the stagnation region, and therefore, the flow amount of the water supplied to the flush toilet 1 decreases. As a result, waste is not discharged from the flush toilet 1 or the bowl portion 4 of the flush toilet 1 is not sufficiently flushed.

In a case where the length of the straight pipe portion 243 is not sufficient, the distance from the jet port 222 to the elbow portion 244 becomes short. Therefore, the water flow (high-speed jet flow) jetted from the jet nozzle 22 is brought into contact with the inner surface of the elbow portion 244 (interferes the flow rate), pressure near the downstream of the straight pipe portion 243 thus increases, and pressure suddenly increases (a pressure gradient becomes steep) toward the elbow portion 244. For this reason, backwater occurs inside the straight pipe portion 243, and thus, a backwater vortex, at which the water flow remains, is formed in the straight pipe portion 243. If the back water vortex occurs in the straight pipe portion 243, energy is unnecessarily consumed in the stagnation region, the jet pump action of drawing the outer fluid into the jet flow is suppressed, and the flow amount of the water supplied to the flush toilet 1 further decreases.

Thus, the length of the straight pipe portion 243 is sufficiently secured as described above to suppress the formation of the backwater vortex in the water flow inside the throat 24 and interference of the inner surface of the throat 24 and thereby to suppress a decrease in the flow amount of the water supplied to the flush toilet 1, according to this embodiment.

In order to efficiently cause the jet pump action and supply a large flow amount of water from the flush water supply device 10 to the flush toilet 1 as described above, it is necessary to secure a sufficient length of the straight pipe portion 243 (to an extent, to which the backwater vortex and the interference of the inner surface of the throat 24 can be sufficiently suppressed). However, it can be considered that if the straight pipe portion 243 is formed to be long, the size of the throat 24 increases together and the size of the tank 11 which accommodates the throat 24 therein also increases.

Thus, the increase in size of the tank 11 is suppressed by forming the straight pipe portion 243 of the throat 24 to be sufficiently long and contriving the arrangement of the throat 24 in the tank 11 in this embodiment. Specifically, the throat inlet port 241 (the end portion of the straight pipe portion 243 on the upstream side) is arranged in the vicinity of the corner CN1, and the center axis of the straight pipe portion 243 inclines with respect to the front-back direction of the tank when viewed from the upper side.

As compared with a case where the center axis of the straight pipe portion 243 is along the front-back direction or the right-left direction of the tank 11 when viewed from the upper side, the straight pipe portion 243 is arranged while the space inside the tank 11 is efficiently utilized in this embodiment. As a result, the tank 11 can be configured in a compact size, and at the same time, the length of the straight pipe portion 243 can be sufficiently secured.

In addition, the jet nozzle 22 is arranged between the corner CN1 and the throat inlet port 241. Such arrangement of the jet nozzle 22 contributes not only to the configuration of the tank 11 in a compact size but also to securing of the length of the straight pipe portion 243.

As described above, the water inside the tank 11 is drawn from the entire circumference of the jet port 222 by the water jetted from the jet port 222 of the jet nozzle 22. At this time, the water flowing from the inside of the tank 11 toward the throat inlet port 241 flows as shown by an arrow W5 in FIG. 3 along the bottom wall 110, the back side wall 114, and the right side wall 112 since the throat inlet port 241 is arranged in the vicinity of the corner CN1. Therefore, even if a variation or non-uniformity (foaming at the water surface in the tank 11, for example) occurs when the water supply from the inside of the tank 11 to the flush toilet 1 is started and the water reserved in the tank 11 flows toward the throat inlet port 241, the water flow is adjusted along the walls (the bottom wall 110, the back side wall 114, and the right side wall 112) in the vicinity of the throat inlet port 241. As a result, it is possible to stably exhibit the jet pump action (flow amount amplifying action) without destabilizing the flow amount of the water flowing from the inside of the tank 11 into the throat 24.

As described above, water flow to be drawn into the throat 24 by water jetted from the jet nozzle 22 is adjusted and efficiency of the jet pump action is enhanced by arranging the throat inlet port 241 in the vicinity of the corner CN1 in this embodiment.

In addition, a relatively large space is formed in the vicinity of the corner CN2 in the tank 11 as shown in FIG. 2 since the throat inlet port 241 is arranged in the vicinity of the corner CN1. By arranging the flush valve 12, which opens and closes the jet water supply pipe arrangement 21, in the vicinity of the corner CN2, the space inside the tank 11 is further efficiently used, and the tank 11 is configured into a compact size. Here, since a relatively large space is formed above a corner CN3 defined by the bottom wall 110, the front side wall 113, and the right side wall 112, the flush valve 12 may be arranged in this space.

Figure 6:
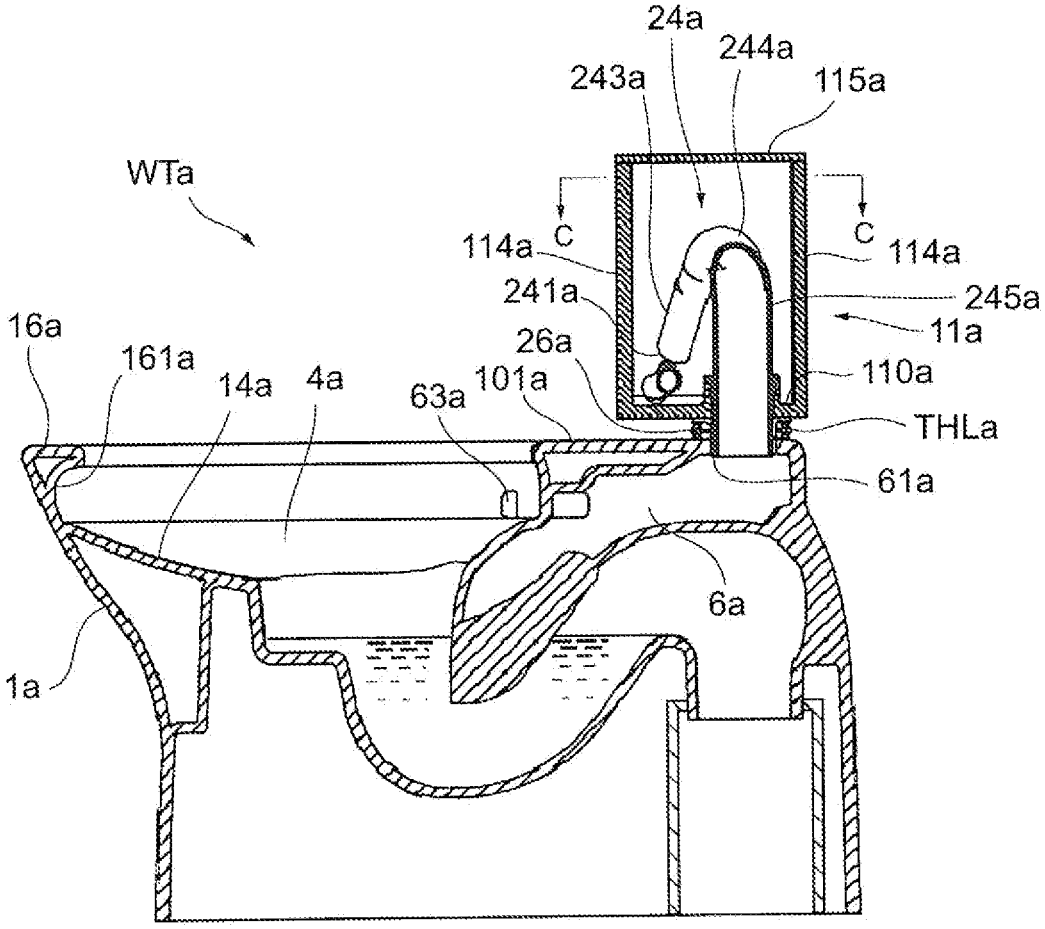
FIG. 6 is an outlined side cross-sectional view of a flush toilet device according to a second embodiment of the present invention.
Figure 7:
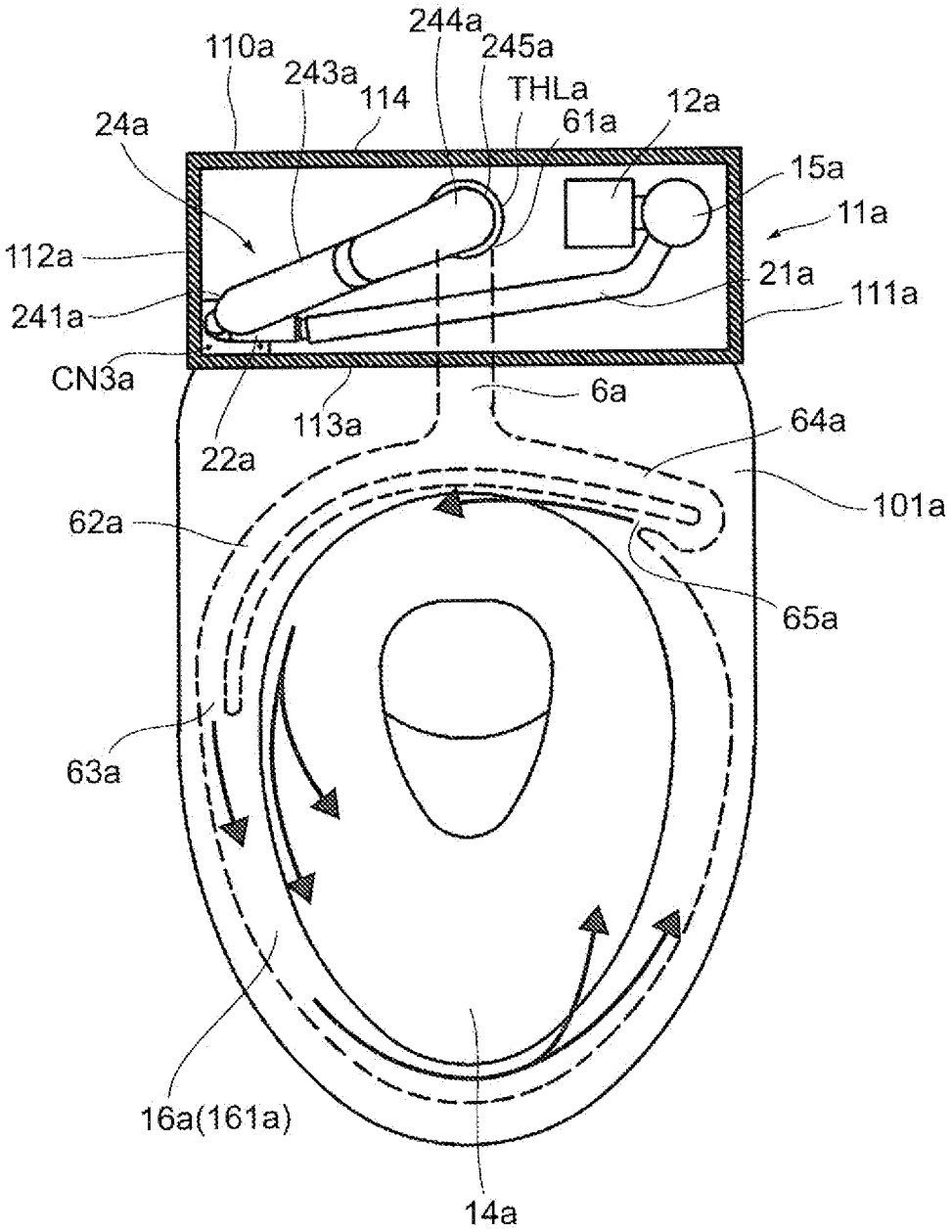
FIG. 7 is an arrow view from a C-C direction in FIG. 6.

Next, a description will be given of a flush toilet device WTa according to a second embodiment of the present invention with reference to FIGS. 6 and 7. FIG. 6 is an outlined side cross-sectional view of the flush toilet device WTa. FIG. 7 is an arrow view from a C-C direction in FIG. 6. Hereinafter, only different points of the flush toilet device WTa from the flush toilet device WT will be described, and descriptions of common points to those of the flush toilet device WTa which was described above will be appropriately omitted.

A flush toilet 1*a* of the flush toilet device WTa is different from the flush toilet 1 in a shape of a water guide path 6*a* formed therein. One end of the water guide path 6*a* opens at an upper surface 101*a* of the flush toilet 1*a*, and the opening functions as an inlet port 61*a* of water supplied from the tank 11*a*. A position, at which the inlet port 61*a* is formed, is a part of the upper surface 101*a* of the flush toilet 1*a* on the back side and at a center part in the right-left direction.

The water guide path 6*a* is branched into two flow paths (a first water guide path 62*a* and a second water guide path 64*a*) on the downstream side thereof. The first water guide path 62*a* as one flow path has one end portion on the downstream side, which opens at a right part of an inner circumferential surface 161*a* of a rim portion 16*a*, and the opening functions as an outlet port of the water (water ejecting portion 63*a*). If water is supplied from the tank 11*a* to the inlet port 61*a*, a part thereof passes through the inside of the first water guide path 62*a* and is ejected from the water ejecting portion 63*a* and supplied to the rim portion 16*a*.

The second water guide path 64*a* as the other flow path has an end portion on the downstream side, which opens at a part on the left back side of the inner circumferential surface 161*a* of the rim portion 16*a*, and the opening functions as an outlet port of the water (water ejecting portion 65*a*). If water is supplied from the tank 11*a* to the inlet port 61*a*, a part thereof passes through the inside of the second water guide path 64*a* and is ejected from the water ejecting portion 65*a* and supplied to the rim portion 16*a*.

A direction, in which water is ejected from the water ejecting portion 63*a* is a direction along a circumference of the inner circumferential surface 161*a* forms as a substantially circular flow path, and is a counterclockwise direction when viewed from the upper side. A direction, in which water is ejected from the water ejecting portion 65*a*, is also a direction along a circumference of the inner circumferential surface 161*a* formed as a substantially circular flow path, and is a counterclockwise direction when viewed from the upper side. As shown by the arrow in FIG. 7, the water ejected from the water ejecting portion 63*a* and the water ejecting portion 65*a* flows while cycling in the counterclockwise direction along the inner circumferential surface 161*a* and flows downward from the entire inner circumferential surface 161*a* toward the waste receiving surface 14*a*.

According to this embodiment, the tank 11*a* is installed at a part of the upper surface 101*a* of the flush toilet 1*a* on the backward side. In addition, a tank supply port THLa which is an outlet port of water reserved in the tank 11*a* is formed so as to penetrate a bottom wall 110*a* in the upper-lower direction instead of penetrating the front side wall 113*a* in the front-back direction. As shown in FIG. 7, the tank supply port THLa and the inlet port 61*a* are overlapped with one another when viewed from the upper side, and both the tank supply port THLa and the inlet port 61*a* are connected via a water supply socket 26*a*. In addition, the tank supply port THLa is formed at a substantially center position of the bottom wall 110*a* in the right-left direction, which is also a position of the bottom wall 110*a* on the backward side (in the vicinity of the back side wall 114*a*).

Although a throat 24*a* has substantially the same shape as that of the throat 24 at a part from a throat inlet port 241*a* to an elbow portion 244*a*, the throat 24*a* has a different shape from that of the throat 24 at a part on the downstream side from the elbow portion 244*a*. A tubular descending portion 245*a* along a vertical direction is formed on a further downstream side of the throat 24*a* than the elbow portion 244*a*. For this reason, the throat 24*a* has an inverted U-shape in side view as shown in FIG. 6. A part of the descending portion 245*a* on the lower side is connected to the tank supply port THLa and the inlet port 61*a*. An opening formed at a lower end of the descending portion 245*a* functions as a throat outlet port 248*a*.

The throat inlet port 241*a* is arranged in the vicinity of a corner CN3*a* defined by the bottom wall 110*a*, the front side wall 113*a*, and the right side wall 112*a* in the tank 11*a*. In addition, a jet nozzle 22*a* is also arranged in the vicinity of the corner CN3*a* below the throat inlet port 241*a* in the same manner as the jet nozzle 22.

In addition, since a relative positional relationship between the jet nozzle 22*a* and the throat inlet port 241, a water jet direction from the jet nozzle 22*a* to a straight pipe portion 243*a*, and the like are the same as those in the case of the flush toilet device WT, detailed descriptions will be omitted.

By forming and arranging the throat 24*a* as described above, the straight pipe portion 243*a* is arranged in a state where the center axis thereof inclines with respect to the front-back direction of the tank 11*a* (it can also be said that the state is a state where the center axis inclines with respect to the right-left direction of the tank 11*a*) when viewed from the upper side as shown in FIG. 7. That is, the straight pipe portion 243*a* extends from the throat inlet port 241*a* which is arranged in the vicinity of the corner CN3*a* toward the sides of the back side wall 114*a* and the left side wall 111*a*.

In the same manner as in the case of the flush toilet device WT, the space inside the tank 11*a* is efficiently utilized and the straight pipe portion 243*a* is arranged in this embodiment. As a result, the tank 11*a* can be configured in a compact size, and at the same time, the length of the straight pipe portion 243*a* can be sufficiently secured.

In this embodiment, the throat inlet port 241*a* is arranged in the vicinity of the front side wall 113*a*, and the throat outlet port 248*a* (tank supply port THLa) is arranged in the vicinity of the back side wall 114*a*. Since the throat 24*a* is arranged inside the tank 11*a* as described above, the throat inlet port 241*a* is not positioned at a further backward side than the position of the throat outlet port 248*a* which is connected to the bottom wall 110*a*. In other words, it is not necessary to extend the shape of the tank 11*a* toward the backward side for the purpose of arranging the throat inlet port 241*a* inside the tank 11*a*. As a result, an increase in dimension of the entire flush toilet device WTa in the front-back direction is suppressed, and a degree of freedom for installing the flush toilet device WTa is enhanced.

In this embodiment, a position, at which the tank supply port THLa is formed, in the bottom wall 110*a*, namely a position of the throat outlet port 248*a* is a position of the bottom wall 110*a* on the backward side (in the vicinity of the back side wall 114*a*). For this reason, it is desired to arrange the throat inlet port 241*a* at a position in the vicinity of the front side wall 113*a* as shown in FIG. 7 in order to sufficiently secure the length of the straight pipe portion 243*a* by efficiently utilizing the space inside the tank 11*a*. That is, it is desired to arrange the throat inlet port 241*a* at a position in the vicinity of one of the front side wall 113*a* and the back side wall 114*a*, which is located on the further side from the throat outlet port 248*a*.

If the position of the throat outlet port 248*a* (the position of the tank supply port THLa) is at the center position of the tank 11*a* in the front-back direction, the throat inlet port 241*a* may be arranged at any one of a position closer to the front side wall 113*a* or a position closer to the back side wall 114*a*. It is possible to sufficiently secure the length of the straight pipe portion 243*a* by efficiently utilizing the space inside the tank 11*a* regardless of which one of the positions the throat inlet port 241*a* is arranged at.

For the same reason, it is desired to arrange the throat inlet port 241*a* at a position in the vicinity of one of the left side wall 111*a* and the right side wall 112*a*, which is further from the throat outlet port 248*a*. In addition, in a case where the position of the throat outlet port 248*a* (the position of the tank supply port THLa) is the center position of the tank 11*a* in the right-left direction as in this embodiment, the throat inlet port 241*a* may be arranged in any one of a position in the vicinity of the left side wall 111*a* and a position in the vicinity of the right side wall 112*a*. It is possible to sufficiently secure the length of the straight pipe portion 243*a* by efficiently utilizing the space inside the tank 11*a* regardless of which one of the positions the throat inlet port 241*a* is arranged at.

The above description was given of the embodiments of the present invention with reference to specific examples. However, the present invention is not limited to the specific examples. That is, appropriate addition of design modifications to the specific examples by those skilled in the art is also included in the scope of the present invention as long as the modifications still have the features of the present invention. For example, the respective components, and arrangement, materials, conditions, shapes, and sizes thereof in the aforementioned specific examples are not limited to the illustrative examples and can be appropriately changed. In addition, the respective components in the aforementioned embodiments can be combined as long as the combination can be technically implemented, and the combinations are also included in the scope of the present invention as long as the combinations still have the features of the present invention.

REFERENCE SIGNS LIST

WT, WTa: flush toilet device
1, 1*a*: flush toilet
101*a*: upper surface
161, 161*a*: inner circumferential surface
2: skirt portion
4: bowl portion
6, 6*a*: water guide path
61*a*: inlet port
62*a*: first water guide path
63*a*: water ejecting portion
64*a*: second water guide path
65*a*: water ejecting portion
8: discharge water trap portion
10: flush water supply device
11, 11*a*: tank
110, 110*a*: bottom wall
111, 111*a*: left side wall
112, 112*a*: right side wall
113, 113*a*: front side wall
114, 114*a*: back side wall
115, 115*a*: cover
THL, THLa: tank supply port
CN1, CN2, CN3, CN3*a*: corner
12, 12*a*: flush valve
13: upstream water supply pipe
14, 14*a*: waste receiving surface
15, 15*a*: vacuum breaker
16, 16*a*: rim portion
18: rack portion
19: water retaining portion
20: water ejecting portion
21, 21*a*: jet water supply pipe arrangement
22, 22*a*: jet nozzle
221: introduction port
222: jet port
223: introduction path
224: outer side surface
225: protrusion portion
23: fixing plate
231: fixing hole
24, 24*a*: throat
241, 241*a*: throat inlet port

242: inlet port flange
243, 243*a*: straight pipe portion
244, 244*a*: elbow portion
245*a*: descending portion
246: outlet port flange
247: connecting portion
248, 248*a*: throat outlet port
25: support pillar
26, 26*a*: water supply socket
34: inlet port
36: ascending path
361: upper end portion
38: expanded portion
40: descending path

What is claimed is:

1. A flush toilet device which receives waste egested by a user and discharges the waste with water, comprising:

a toilet which includes a bowl portion for receiving the waste and a water guide path formed therein to guide the water to the bowl portion; and a flush water supply device which supplies the water to the water guide path, wherein the flush water supply device includes a tank which reserves the water therein and includes a supply port formed to supply the water to the water guide path, wherein the tank includes a bottom wall which forms a bottom surface of the tank, a first side wall which extends upward from the bottom wall and forms a side surface of the tank on a left side, and a second side wall which extends upward from the bottom wall and forms a side surface of the tank on a fight side, and wherein the inlet port portion is arranged at a position in a vicinity of one of the first side wall and the second side wall, which is located at a further position from the outlet port portion, the tank further includes a third side wall which extends upward from the bottom wall and forms a side surface of the tank on a front side, and a fourth side wall which extends upward from the bottom wall and forms a side surface of the tank on a back side, a jet nozzle which is arranged on a lower side in the tank and jets the water, a jet water supply pipe arrangement which supplies the water to the jet nozzle, and a throat which is a pipe arranged inside the tank and connected to the supply port on one end side, wherein the throat includes an inlet port portion which causes water jetted by the jet nozzle and water inside the tank to be drawn by the jetted water to flow therein, a straight pipe portion which is formed so as to extend on a straight line from the inlet port portion along a jet direction of the jet nozzle, a bending portion which is a part on a further downstream side than the straight pipe portion and is formed so as to bend, and an outlet port portion which is a part connected to the supply port and causes water passing through the straight pipe portion and the bending portion to flow out to the supply port, wherein the inlet port portion is arranged at a position in a vicinity of one of the third side wall and the fourth side wall, which is located at a further position from the outlet port portion, and wherein the straight pipe portion is arranged in a state where a center axis thereof intersects with a vertical plane extending in a front-back direction of the tank in a top view.

2. The flush toilet device according to claim 1, wherein the supply port is formed so as to penetrate through the bottom wall, and the tank is arranged at a part of an upper surface of the toilet on a backward side, wherein the inlet port portion is arranged in a vicinity of the third side wall, and wherein the outlet port portion is arranged in a vicinity of the fourth side wall.

3. A flush toilet device which receives waste egested by a user and discharges the waste with water, comprising:

a toilet which includes a bowl portion for receiving the waste and a water guide path formed therein to guide the water to the bowl portion, said water guide path extending in a front-back direction of the toilet when viewed from an upper side; and a flush water supply device which supplies the water to the water guide path, wherein the flush water supply device includes a tank which reserves the water therein and includes a supply port formed to supply the water to the water guide path, wherein the tank includes a bottom wall which forms a bottom surface of the tank, a first side wall which extends upward from the bottom wall and forms a side surface of the tank on a left side, and a second side wall which extends upward from the bottom wall and forms a side surface of the tank on a fight side, and wherein the inlet port portion is arranged at a position in a vicinity of one of the first side wall and the second side wall, which is located at a further position from the outlet port portion, the tank further includes a third side wall which extends upward from the bottom wall and forms a side surface of the tank on a front side, and a fourth side wall which extends upward from the bottom wall and forms a side surface of the tank on a back side, a jet nozzle which is arranged on a lower side in the tank and jets the water, a jet water supply pipe arrangement which supplies the water to the jet nozzle, and a throat which is a pipe arranged inside the tank and connected to the supply port on one end side, wherein the throat includes an inlet port portion which causes water jetted by the jet nozzle and water inside the tank to be drawn by the jetted water to flow therein, a straight pipe portion which is formed so as to extend on a straight line from the inlet port portion along a jet direction of the jet nozzle, a bending portion which is a part on a further downstream side than the straight pipe portion and is formed so as to bend, and an outlet port portion which is a part connected to the supply port and causes water passing through the straight pipe portion and the bending portion to flow out to the supply port, wherein the inlet port portion is arranged at a position in a vicinity of one of the third side wall and the fourth side wall, which is located at a further position from the outlet port portion, and wherein the straight pipe portion is arranged in a state where a center axis thereof intersects with a vertical plane extending in the front-back direction of the tank in a top view.

* * * * *